US006237588B1

(12) United States Patent
Hawkinson

(10) Patent No.: US 6,237,588 B1
(45) Date of Patent: May 29, 2001

(54) OUTDOOR CONVERTIBLE WOOD BURNING FIREPLACE

(75) Inventor: Eric Paul Hawkinson, Prior Lake, MN (US)

(73) Assignee: Heat-N-Glo Fireplace Products, Inc., Lakeville, MN (US)

( * ) Notice: Subject to any disclaimer, the term of this patent is extended or adjusted under 35 U.S.C. 154(b) by 0 days.

(21) Appl. No.: 09/524,151

(22) Filed: Mar. 14, 2000

(51) Int. Cl.[7] ..... F24B 1/18
(52) U.S. Cl. ..... 126/500; 126/512
(58) Field of Search ..... 126/500, 512, 126/529, 531; 431/125

(56) References Cited

U.S. PATENT DOCUMENTS 5,671,727 * 9/1997 Squires et al. ..... 431/125
5,941,237 * 8/1999 Shimek et al. ..... 126/512

FOREIGN PATENT DOCUMENTS

2123944 * 2/1984 (GB) ..... 126/512

* cited by examiner

*Primary Examiner*—Sara Clarke
(74) *Attorney, Agent, or Firm*—John B. Sowell

(57) ABSTRACT

A rust proof indoor-outdoor convertible fireplace is provided with an open side having access into the combustion chamber box. The combustion chamber box is provided with an inclined bottom panel to drain water from rain and snow products from said combustion box. Support structures are provided on or above said inclined bottom panel for supporting a ceramic floor in a horizontal plane juxtaposed and above said inclined bottom panel. The inclined bottom panel is provided with a hole or aperture and forms the top panel of a water tight box that is used to house a gas control valve and electrical controls when the outdoor fireplace is converted from wood burning to a gas burning fireplace.

8 Claims, 3 Drawing Sheets

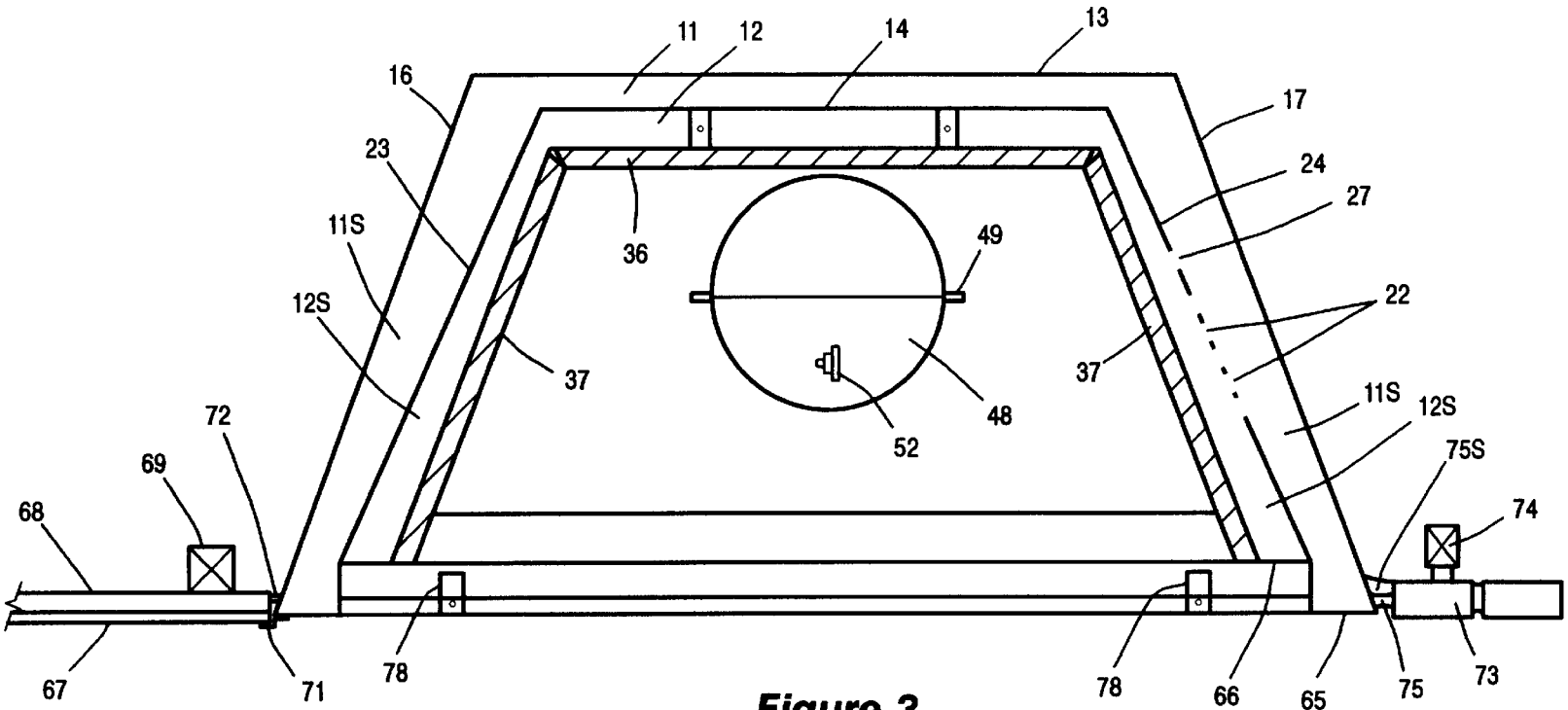
Figure 3
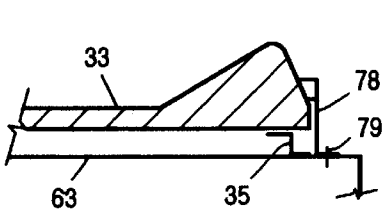
Figure 4
Figure 5

OUTDOOR CONVERTIBLE WOOD BURNING FIREPLACE

BACKGROUND OF THE INVENTION

1. Field of the Invention

The present invention relates to prefabricated sheet metal wood burning fireplaces for use in an exposed outdoor environment. More particularly, the present invention relates to a rust proof and weatherproof outdoor fireplace for burning wood and for conversion to burning gas.

2. Description of the Prior Art

Wood burning stoves and wood burning fireplaces are well known in the prior art and are classified in Class 126 subclasses 77, 85, 92, 193, etc.

Prefabricated fireplaces for burning wood are known to be designed for conversion to burn gas with the addition of a gas burner and controls for supplying proper gas flow to the gas burner. Such fireplaces have heretofore been installed inside of a house in a protective environment even when placed in a wall where they can be seen from the outside.

It would be desirable to provide a fireplace with an attractive outer enclosure which could be used completely outside of a house such as placed on a patio or deck and be immune to hostile adverse weather conditions such as rain, sleet, snow and ice accompanied by heavy wind and yet always be ready for use as an outdoor fireplace.

SUMMARY OF THE INVENTION

It is a primary object of the present invention to provide a universal outdoor fireplace capable of stand alone use outside of a house or for being placed in or against an outside wall of a house.

It is a primary object of the present invention to provide a wood burning fireplace for outside use that may be converted to a gas burning fireplace.

It is primary object of the present invention to provide a wood-burning fireplace that may be left outside in hostile weather conditions.

It is a general object of the present invention to provide an outside universal wood burning fireplace that is rust proof and convertible to an outside gas burning fireplace and can be used as an outside/inside fireplace.

According to these and other objects of the present invention there is provided a prefabricated fireplace having an outside rust proof ornamental shroud or cover attached to a double panel inner fireplace unit. The inner fireplace unit comprises a combustion chamber box that is lined with ceramic material at the vertical sides and at the floor. The ceramic floor s supported in a horizontal plane juxtaposed the floor panel of the combustion chamber which is inclined from rear to front to prevent water entrapment. A novel waterproof compartment is constructed below the floor panel.

BRIEF DESCRIPTION OF THE DRAWINGS

FIG. 3 is a section in plan view taken through the vertical panels of the fireplaces of FIGS. 1 and 2 and showing the exhaust stack and damper above the section line;

FIG. 4 is an enlarged detail of the rear support bracket shown in FIGS. 1 and 2 for supporting a ceramic floor insert; and FIG. 5 is an enlarged detail of the front drip edge of the fireplaces of FIGS. 1 and 2.

DETAILED DESCRIPTION OF THE PREFERRED EMBODIMENTS

Figure 1:
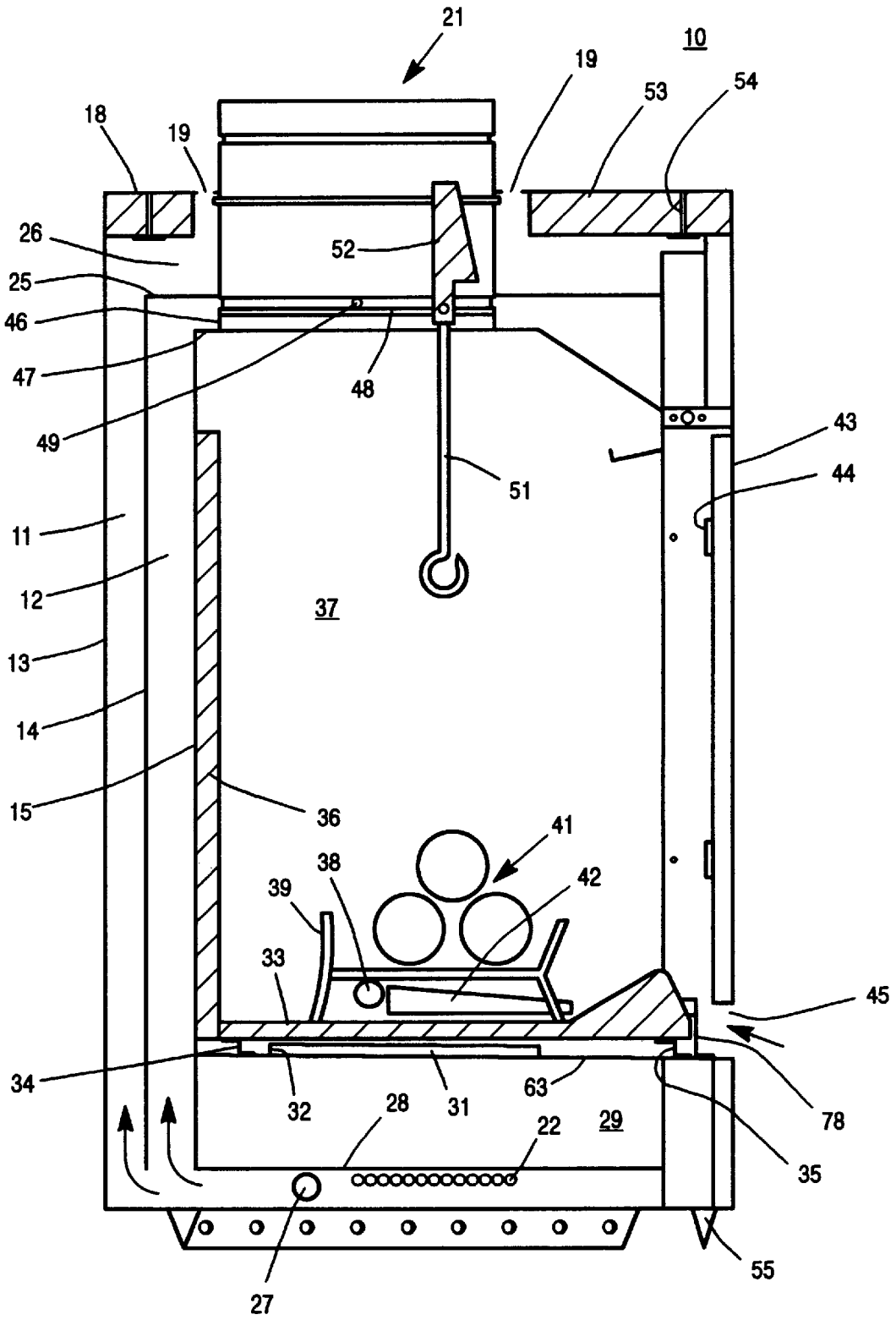
FIG. 1 is a section in side elevation of a preferred embodiment convertible wood burning fireplace.

Refer now to FIG. 1 showing a present preferred embodiment wood burning fireplace 10 which has two air spaces 11 and 12 formed between the panels 13, 14 and 14, 15 respectively. The outer back panel 13 is connected to outer side panels 16 and 17, all of which connect to outer top panel 18 which has bleeder holes 19 surrounding the stack 21. Bleeder holes 22 are provided in some or all of the outer panels 13, 16 and 17 so that air entering holes 22 passes through air space 11 and along the side air spaces and exits through bleeder holes 19.

Middle panel 14 is connected to middle side panels 23 and 24, all of which are shorter than panel 13 and start above holes 22, thus, air space 12 also communicates with holes 22. In the preferred embodiment, top middle panel 25 connects to middle panels 14, 23 and 24 and need not be made air tight so that air leaks into air space 26 and out bleeder holes 19. As will be explained hereinafter, the side air spaces (like rear air spaces 11 and 12) are closed at the front so that no moisture from the front enters the aforementioned air spaces 11, 12 and 26 or side air spaces.

A gas line access or knock-out hole 27 is provided in a side or back outer panel below bottom panel 28 which forms a panel in a water tight closure 29 accessible by a round or rectangular hole 31 surrounded by an upward extruded flange 32. The gas valve and burner controls (not shown) are placed in closure 29 when a gas conversion fireplace is implemented. In the wood burning fireplace 10 shown, the dense ceramic concrete floor 33 is supported on four sides by formed shapes 34 and 35 and by side supports such as angle shapes (not shown). The floor and side ceramic insert panels 36, 37 are preferably held by mechanical fasteners as will be explained.

A punch out plug 38 is shown in the side of panel 37 and coincides with a knock-out hole in a middle side panel or back panel for use in gas conversion units as will be explained hereinafter.

In the wood burning fireplace there is provided a raised grate 39 supported on floor 33 for supporting wood logs 41. An ash or burner pan 42 is shown positioned below the logs 41 and is readily removable from the front which is preferably left open but may be provided with double glass doors 43 supported by side hinges 44. Note that an air space 45 is provided below the glass doors.

Exhaust gas produced by burning logs 41 passes through a formed hole 46 in top panel 47 and into exhaust stack 21. A horizontal damper 48 is mounted in the stack 21 on pivot 49 and may be opened or closed manually by control rod 51 pivotally mounted thereon at counterweight/stop 52.

A thick panel of fiber insulation 53 is mounted below outer top panel 18 and held in place by fastening means such as spot nails 54. Insulation 53 has a hole larger than stack 21 so that the bleed holes 19 are exposed to air space 26.

In the preferred embodiment of the present invention, the fireplace 10 is built into a chase which abuts the outer wall of a house or alternatively mounted through a wall of a house and extends into an insulated chase inside of a house. In either event, rules and regulations applicable to wood burning fireplaces require that the stack 21 extend two feet above any part of the house within ten feet of the vertical stack extension. The unit 10 may be supported by wooden or metal or masonry supports resting on legs 55.

Figure 2:
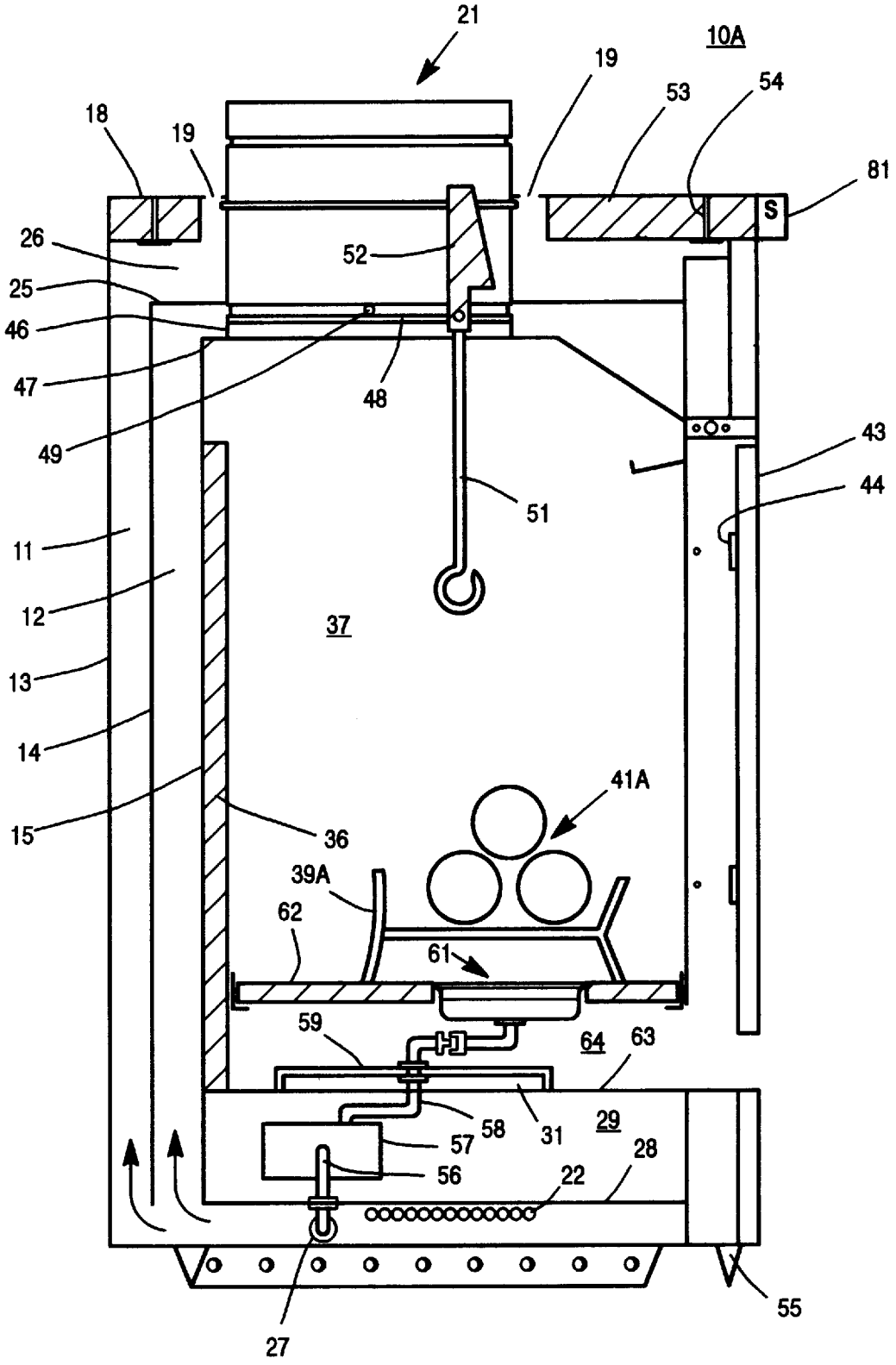
FIG. 2 is a section in side elevation of the fireplace of FIG. 1 converted to a gas-burning fireplace.

Refer now to FIG. 2 showing a gas burning fireplace 10A conversion using most of the fireplace 10 structure. Elements in this fireplace 10A which are the same as those described in FIG. 1 are numbered the same and will not require additional explanation. A gas line 56 is shown passing through hole 27 and through a hole in bottom panel 28. Gas line 56 is connected to a gas control valve 57 which supplies gas via line 58 and a water tight lid or cap 59 into a gas burner system 61 mounted into a raised floor panel 62 spaced above panel 63 and forming a chamber 64 for combustion air there between. A grate 39A is positioned over burner system 61 and supports artificial logs 41A. The conventional gas burner system 61 may be replaced with a set of logs 41A that are hollow and act as burner elements. Such burners are shown and described in U.S. Ser. No. 08/705,845, now U.S. Pat. No. 6,048,195 for Hollow Ceramic Fiber Burner Log Element(s) assigned to the same assignee as the present invention and is incorporated by reference herein. Other conventional gas burners may be used. Such burners may be supported directly on the cap 59 so that floor panel 62 and its support brackets are not required This permits the grate 39A to rest on slanted floor panel 63.

Refer now to FIG. 3 showing a plan view in section taken through the fireplace 10 or 10A and damper 48 superimposed thereon. The rear air spaces 11 and 12 are shown connecting into side air spaces 11S and 12S. Bleeder holes at numeral 22 and knock out hole 27 provide access into air space 11S. Side panels 23, 24 do not extend downward past panel 28 so that air which enters air space 11S also passes into air space 12S. Both air spaces 11S and 12S are sealed along the front by panels 65 and 66, respectively. However, as explained hereinbefore, air entering bleeder holes 22 which enters air spaces 11S and 12S is allowed to exit via bleeder holes 19. The double air chambers 11, 11S and 12, 12S form an insulation barrier for the hot combustion chamber and permit the fireplace to be mounted directly against a wall or wooden structure.

On the left side of the FIG. 3 fireplace there is shown a strip of siding 67 mounted on a siding board 68 mounted on a wooden stud 69. If the siding 67 has an open end, a trim piece 71 is mounted over the end and the gap at the wall and fireplace is sealed with resilient caulking such as silicone sealer 72.

On the right side of FIG. 3 a masonry or brick wall facing 73 in front of a stud or framing 74 is aligned next to the fireplace and is sealed with grout 75 as well as a resilient seal 75S behind the grout 75. When the surface of the edge of the fireplace is prepared with a grid or mesh, the grout 75 alone will form a permanent seal.

Refer now to FIG. 4 showing an enlarged partial section in elevation of a support bracket 34 for supporting the floor 33 at the rear. The shape shown is intended to prevent entrapment of water on panel 63; thus, numerous other formed shapes are equally feasible.

Refer now to FIG. 5 showing an enlarged partial section in elevation of a support bracket or brackets 35 and retainers 78 having a "Z" shape and held in place by screws 79. It will be understood that brackets 35 and retainers 78 are either perforated or discontinuous so that water formed on inclined panel 63 is free to flow out of the bottom of the fireplace 10 and 10A.

Having explained a fireplace that is intended to be left open to the elements, this does not conflict with the preferred installation where only the front opening of the fireplace is exposed to outside elements and a chase or decorative structure surrounds the remainder of the fireplace and water can not get into the bleeder holes 19 or through the top of panel 18. The preferred embodiment fireplace is designed for stand alone installation on patios and decks and may be ordered with stainless steel stacks 21 which have a protective cover (not shown) which fits over the stack and bleeder holes 19 and prevents direct entry of water into the air spaces or combustion chamber.

Panels of stainless steel will insure that the fireplace will remain rust proof, however, steel coated with rust proof metallic coatings are an alternative when some of the panels are not exposed to the outside environment. The compartment 29 that may house the gas control valve 57 should be water tight if not substantially air tight and only control valves and electronic modules that are rated for outside temperature conditions should be used.

When a gas conversion unit is installed, it is also preferred to install an on-off switch 81 for activating the burner system. An expensive alternative would be to incorporate a RF remote actuated control unit on the gas valve. Manual controls may be placed above or below the cap 69 where they can be reached, but should not present a leak in the watertight system.

The grates, gas burners and artificial logs used in conversion units merely supplement the basic convertible fireplace and preferably are usually sold and installed after the basic wood burning fireplace which is operable as a stand alone fireplace before or after partial or full custom enclosures are added.

What is claimed is:

1. An indoor-outdoor convertible fireplace, comprising:

said fireplace having an inner combustion chamber box with one open side for exposure to outside weather conditions;

said inner combustion chamber box having surrounding interconnected vertical sides and top panels which form two separate air barrier walls, a bottom panel in said combustion chamber box being inclined from rear to front for draining outside weather condition moisture out of the inner combustion chamber box, said bottom panel of said combustion chamber box forming a top panel of a watertight box, an access aperture in said bottom panel, a water barrier surrounding said access aperture, and support means in a bottom of said combustion chamber box for supporting a floor panel in a horizontal plane above said inclined bottom panel.

2. The convertible fireplace as set forth in claim 1 which further includes:

said floor panel comprising a high-density ceramic floor panel positioned on said support means above said access aperture in said bottom panel.

3. The convertible fireplace as set forth in claim 2 wherein said water barrier surrounding said access aperture comprises a vertically extending flange.

4. The convertible fireplace as set forth in claim 3 wherein said flange is formed integral with and is a part of said bottom panel.

5. The convertible fireplace as set forth in claim 1 which further includes a water tight cap closely fitted onto said water barrier for providing a closure for said water tight box.

6. The convertible fireplace as set forth in claim 1 which further includes:

said floor panel comprising a ceramic floor panel positioned on said support means and forming an air chamber between said ceramic floor panel and said bottom panel, gas control means in said watertight box for connection to a gas source, gas burner means in or above said floor panel coupled to said gas control means, and closure means on said water barrier surrounding said access aperture for sealing said gas control means in said watertight box.

7. The convertible fireplace as set forth in claim 6 wherein said burner means comprises a burner in said floor panel.

8. The convertible fireplace as set forth in claim 7 wherein said burner further comprises a hollow log burner.

* * * * *